US010082046B2

(12) United States Patent
Adle

(10) Patent No.: US 10,082,046 B2
(45) Date of Patent: Sep. 25, 2018

(54) VORTEX TURBINE ENGINE

(71) Applicant: Donald Lee Adle, Clearwater, FL (US)

(72) Inventor: Donald Lee Adle, Clearwater, FL (US)

( * ) Notice: Subject to any disclaimer, the term of this patent is extended or adjusted under 35 U.S.C. 154(b) by 0 days.

(21) Appl. No.: 15/062,292

(22) Filed: Mar. 7, 2016

(65) Prior Publication Data

US 2017/0254224 A1 Sep. 7, 2017

(51) Int. Cl.
*F01K 11/02* (2006.01)
*F01K 3/00* (2006.01)
*F01K 13/00* (2006.01)

(52) U.S. Cl.
CPC ..... *F01K 11/02* (2013.01); *F01K 3/002* (2013.01); *F01K 13/006* (2013.01)

(58) Field of Classification Search
CPC ..... F01K 11/02; F01K 13/006; F01K 3/002
See application file for complete search history.

(56) References Cited

U.S. PATENT DOCUMENTS 3,973,404 A * 8/1976 Iizuka ..... F01D 3/02 415/101
4,382,746 A * 5/1983 Retz ..... F03B 1/02 415/202
7,086,823 B2 * 8/2006 Michaud ..... F03D 1/04 415/4.2
7,980,078 B2 * 7/2011 McCutchen ..... F28D 15/0233 60/645
8,475,124 B2 * 7/2013 Dalsania ..... F01D 9/06 415/207
9,341,085 B2 * 5/2016 Madison ..... F03G 6/003
2010/0199630 A1 * 8/2010 Belcher ..... F01K 11/02 60/39.182
2015/0059364 A1 * 3/2015 Van Valkenburgh ..... F25B 9/04 62/5
2016/0047279 A1 * 2/2016 Hardgrave ..... F01K 11/00 60/645

* cited by examiner

*Primary Examiner* — Michael C Zarroli

(57) ABSTRACT

An embodiment apparatus draw in a medium low pressure gas by a component cylinder fan, using a vortex system increasing its pressure. Using a split-system, adjustable outlet valve increasing latent heat output. With its Increase latent heat output value, uses a component heating chamber for condensate water absorbs latent heat to pressurized steam conversion for its component steam turbine. System reclaims its water for a cycle thereat. Eliminating range anxiety; Vehicles, Watercrafts, Residential, Commercial or Industrial.

20 Claims, 2 Drawing Sheets

VORTEX TURBINE ENGINE

REFERENCE TO MICROFICHE APPENDIX

Not applicable.

STATEMENT REGARDING FEDERALLY SPONSORED RESEARCH OR DEVELOPMENT

Not applicable.

CROSS-REFERENCE TO RELATED APPLICATIONS

References Cited: U.S Patent Documents

US-2010/019630 A1-August, 2010-Belcher
U.S. Pat. No. 9,341,085 B2-May, 2016-Madison
U.S. Pat. No. 8,475,124 B2-July, 2013-Dalsania
US-2016/0047279 A1-February, 2016-Hardgrave
U.S. Pat. No. 3,973,404 A-August, 1976-Lizuka
U.S. Pat. No. 7,086,823 B2-August, 2006-Michaud
Application 2013/1401284—Inventor: Van Valkenburgh et al * Aug. 28, 2013

INDUSTRIAL APPLICABILITY

Vortex Turbine Engine also known as embodiment apparatus 02 is a useful powertrain for eliminating range anxiety in mobile units. The said embodiment 02 is a useful powertrain in all kinds of vehicles; cars, vans, auto trucks, buses, or watercrafts. Be a useful powertrain for the residential, commercial or industrial uses.

A embodiment apparatus 02 is useful for its non-polluting energy-efficient system. The said embodiment 02 uses no fuel, like oil or gas, the only energy that being used is the electricity for a component cylinder fan 10 from its cylinder motor. Of the main portion of the embodiment there will be only two moving embodiments. With a minimum of moving embodiments this translates into virtually little maintenance.

A embodiment apparatus 02 application generally relates to a two or a plurality of a component spiral tube 04 and by using an component vortex cylinder 14 for its temperatures separation effect, having its gas latent heat separate from its gases. Using this separated high temperatures, then releasing this gas latent heat energy, condensate water to pressurized steam conversion. The said steam used in a component steam turbine 24, producing torque for its applications needs.

TECHNICAL FIELD

A embodiment apparatus 02 relates generally by using a low pressure kinetic ambient gas (mixture mainly of oxygen and nitrogen) medium that being drawn in, then being able to by generating this medium to a very high kinetic moving gas pressure. The said embodiment 02 is a closed area having an opening at each one of a component spiral tube 04 at its ambient gas intake, with an opening at a component heating chamber 16 at its gas vent, and also an opening at a component flash chamber 20 at its cooling vent. The ambient gas medium is drawn into said embodiment 02 through said component 04 ambient gas intake. Each one of said component 04 ambient gas intake is set at an angle to advance, generate, induce a spin tangentially a vortex within. The said component 04 each one has a converging portion that has a greater diameter than the diverging portion to enhance the gas flow vortex intensity.

The gas stream gains velocity while the circumventing gas move forward, the gas is drawn circumventing through its one of the one, two or a plurality of said component spiral tube 04 with its ingrained vortex nozzle and then through its one of the two or a plurality of a component narrowing generator 06 with its ingrained vortex nozzle. There be the same amount of numbers of said component 04 with its vortex nozzle as there are in numbers of said component 06 with its vortex nozzle.

Each one of said component spiral tube 04 vortex nozzle be connected to its one of said component narrowing generator 06. Each one of said component 04 and along with each one of said component 06, all of these has a converging portion that has a greater diameter than the diverging portion, to enhance its vortices intensity. The drawing of the gas causes a low pressure in front of the high pressured regions, causing the molecules to accelerate toward the low pressure regions.

The said component spiral tube 04 with its vortex nozzle, said component narrowing generator 06 with its vortex nozzle, a component fan housing 08, and their gas stream is being drawn into said embodiment apparatus 02 by a component cylinder fan 10. The said component 10 joined to and lay in-between said component 08 within its inner wall. The said component 10 spin on its horizontal-axis between the diameter interior side walls of said component 08. Then said component 10 drives the gas stream to via a component advance chamber 12.

The said component advance chamber 12 having an tube outlets with its high speed gas stream to via and to advance, generate, and helps to form a vortex within a component vortex cylinder 14 giving said component 14 with continuous gas stream. The said component 14 is a split-system, splitting its gas latent heat from its gases. The said component 14 there be a temperature separation effect, separating the gas latent heat from its gas stream. The said component 14 cold gas stream via a component cooling chamber 18. The said component 14 with its said gas latent heat to via its narrowing outer hot end outlet and then its gas latent heat to via its adjustable hot outlet valve and then said gas latent heat via said component heating chamber 16.

Using said component vortex cylinder 14 with its in effect, releasing gas latent heat energy, to be used for the condensate water to absorbs latent heat to pressurized steam conversion within a component condenser tube 22 within said component 22. The said component 22 with its pressurized steam, the pressurized steam via a component steam turbine 24. The said pressurized steam drive said component 24. The said component 24 uses this pressurized steam to force a component drive shaft 26 to rotate on its horizontal-axis producing torque.

The said component vortex cylinder 14 with its inner cold end, its cold gas being used with a component cooling tube 28, said cold gas stream absorb the latent heat energy within the exhaust steam coming from said component steam turbine 24, having a exhaust steam to exhaust water conversion. The said component 28 uses a component water pump 30 to pump the warm condensate water to via said component 22 for the said cycle thereat.

The gas latent heat emerging from today's vortex tube. The today's vortex tube outer hot end can reach temperatures as high as +200° C. and the gas emerging from its inner cold end can reach −50° C. The said component vortex cylinder 14 separate its gas stream into an gas latent heat stream and a cold stream. Each one of said component spiral tube 04 narrowing passageway, along with each one of said component narrowing generator 06 narrowing passageway, said component advance chamber 12 tube outlets, said component 14, each one of these has a converging portion that have a greater diameter than the diverging portion, as these enhance the vortices intensity giving an added higher temperatures and pressure.

The said component vortex cylinder 14 with its narrowing outer hot end outlet with its adjustable hot outlet valve, this give the needed added higher pressure and temperature. Giving said component steam turbine 24 the needed 500° C. (932° F.) steam temperature (500 kPa =72.5188 Psi-up to 700 kPa =101.52642 Psi). Results in an increase of the twice maximized cooling heat transfer rate of nearly 330% from 300 kPa to 700 kPa. Note the compression factor increases as the condition state approaches the saturated vapor state. The actual separation occurs at a medium pressure (approximately 500 to 1,000 psia,) amid a phase change for water (for example: 470.5° F./517 psia and 509.37° F./740 psia) from the liquid bubble point to a completely dry steam.

The water boils at 100° C. at the standard temperature and pressure. The said component vortex cylinder 14 with its narrowing outer hot end outlet using its gas latent heat to heat the water lying within said component condenser tube 22. The said component 14 narrowing outer hot end outlet be releasing its gas latent heat energy, used for condensate water to absorbs latent heat to pressurized steam conversion within said component 22. The said component 14, its inner cold end be releasing its cold gas to cool the hot water, laying within said component cooling tube 28, to have an exhaust steam to warm water conversion.

A component flash thermostatic valve 32 with its diverter valve, said diverter valve divert the flash steam from said component cooling tube 28 diverted to a component flash tube 34 having its exhaust water latent heat to be absorb by the cool gas within said component flash chamber 20. Said component 20 with its gas latent heat, said component 34 absorbs said latent heat for an exhaust steam to hot water conversion. The said component 34 with its exhaust steam to hot water conversion within, the hot water be pumped by a component flash pump 36. The said component 36 pump this hot water to via said component cooling tube 28 toward said component water pump 30. Said component 28 with its exhaust water to warm water conversion within, the warm water via said component water pump 30. The said component 30 pumps said warm water to via said component condenser tube 22, having a releasing gas latent heat energy, the condensate water absorbs latent heat for an pressurized steam conversion cycle thereat.

The gas latent heat transfer to the water to make a condensated steam conversion are well known. The gases lie within said component cooling chamber 18. The exhaust steam and exhaust water to warm water heat transfer of the latent heat to the cold gases also are well known. Also being well known is releasing gas latent heat energy, the condensate water absorbs latent heat to pressurized steam conversion. The Ranque-Hilsch vortex tube and the steam turbines are well known. The said component vortex cylinder 14 is similar to and with many characterize of the Uni-flow vortex tube. The said component steam turbine 24 is similar to and with many characterize of other steam turbines.

BACKGROUND WITH ITS NEEDS

A embodiment apparatus 02 will have a much broader use by using a releasing gas latent heat energy, the condensate water to pressurized steam conversion transfer systems, as an alternative to the conventional fuel driven systems. The said embodiment 02 is a non-polluting energy-efficient system. The said embodiment 02 uses no fuel, like oil or gas, the only energy that being used is the electricity from a component cylinder fan 10 cylinder motor.

A embodiment apparatus 02 uses a two or a plurality of a component spiral tube 04 with its vortex nozzle will be connected with its one of a component narrowing generator 06 producing a high moving gas stream medium for a component vortex cylinder 14. There be the same amount of numbers of said component 04 with its vortex nozzle as there are in numbers of said component 06 with its vortex nozzle. The said component 14 with its vortex, the vortex have a temperatures separation effect. The vortex separated high temperatures produce the gas latent heat to be used for an condensate water to pressurized steam conversion by a component steam turbine 24 producing torque for a component drive shaft 26.

The Ranque-Hilsch vortex tube and the steam turbines are well known, as these has many characterize with a component vortex cylinder 14 and with a component steam turbine 24. An embodiment apparatus 02 is an energy-efficient system, by using a low pressure ambient gas to produce a high moving gas stream medium. The said component 14 is producing the gas latent heat energy to generate the water conversion for the needed pressurized steam to drive said component 24 producing torque for a component drive shaft 26.

The government regulations and consumer demands strongly encourage more energy-efficient fuel systems. Energy-efficient fuel systems are needed in: residential, commercial, industrial, automobiles, and watercrafts motors. These systems are now being used, generally be using a relatively high amount of energy. An embodiment apparatus 02 is useful for its non-polluting high energy-efficient system.

The United States emission standards and managed by the Environmental Protection Agency (EPA) and California Air Resources Board wields an enormous influence over the emissions requirements, set specific limits to the amount of pollution that can be released into the environment. America's has roughly 1,600 existing coal and gas-fired plants generate about 40% of the country's carbon dioxide emissions. An embodiment apparatus 02 is useful in cutting down on these carbon dioxide emissions requirements. Be useful in power stations, generating stations and or generating plants.

The United Nations'Intergovernmental Panel on climate Change says that global warming is here, human-caused and probably already dangerous. In studying the problems caused by the burning of fossil fuels, such as coal, oil and gas paints a harsh warning of what's causing global warming. Continued emission of greenhouse gases will cause further warming and long-lasting changes in all components of the climate system. Power plants account for roughly one-third of all U.S. emissions of the heat-trapping gases blamed for global warming, making them the largest single source. An embodiment apparatus 02 is useful in meeting the global warming requirements.

Research from NASA'S Goddard Space Flight Center shows that large quantities of a chemical responsible for depleting the ozone layer are still being emitted, ever years after an international ban. Though the ozone layer has seemed some recovery since the Montreal Protocol, the ozone hole still persists today. An embodiment apparatus 02 is useful in meeting these ozone requirements, by using non-polluting ambient gas medium for its energy needs.

The current torque driven systems utilize a considerable amount of energy. As oil or gas shortages have started to drive the fuel cost up there is concern about the cost of running these current torque systems. The current torque systems need to be designed with considerations of being low in polluting, with efficiency in mind, with an attempt to obtain more energetic systems an embodiment apparatus 02 meets this efficiency.

A embodiment apparatus 02 eliminate the problem of range anxiety associated to all-electric vehicles. Other benefits include improved national energy security, with the convenience of home recharging, opportunities to provide emergency backup power in the home, and vehicle-to grid (V2G) applications.

A embodiment apparatus 02 replaces a lot of the current high energetic mobile driven systems with said embodiment 02 energy saving system. The said embodiment 02 is useful powertrain in versions for all kinds of vehicles, vans, trucks, buses, and watercrafts.

SUMMARY OF THE INVENTION

A embodiment apparatus 02 also be known as Vortex Turbine Engine; the present invention relates to an gas (mixture mainly of oxygen and nitrogen) gas driven and a steam driven system. The said embodiment 02 will have a much broader use by using a gas latent heat transfer systems, as an alternative to the conventional fuel driven systems. The said embodiment 02 is a non-polluting energy-efficient system.

The said embodiment apparatus 02 is a closed area that have an opening at each one of a component spiral tube 04 at its ambient gas intake, with an opening at a component heating chamber 16 at its gas vent, and with an opening at a component flash chamber 20 at its cooling vent. The said embodiment 02 is suitable as a one, two, or a plurality of units.

Of the main portion of the embodiments there will be only two moving of said component; that being a component cylinder fan 10 that being powered by its cylinder motor and the other one be a component steam turbine 24 producing torque for a component drive shaft 26. The said embodiment apparatus 02 uses no fuel, like oil or gas, the only energy that being used is the electricity for said component 10 cylinder motor. The said embodiment 02 uses no refrigerant of any kind to cool the gas stream. With only a minimal of moving parts, this translates into virtually little maintenance.

Summary: A Component Apparatus Split-system

A portion of a embodiment apparatus 02 is a non-vapor compression embodiment, this portion of said embodiment 02 be known as; a component apparatus split-system (non-vapor compression, heating, cooling and refrigeration) systems. The said apparatus split-system is a non-vapor compression that uses no refrigerant. The said apparatus split-system has an split-system with its temperatures separation effect be useful for its non-vapor compression, heating and cooling and refrigeration systems.

The said apparatus split-system comprises of: A component spiral tube 04, a component narrowing generator 06, a component fan housing 08, a component cylinder fan 10, a component advance chamber 12, and said component vortex cylinder 14.

The said apparatus split-system uses said component spiral tube 04, and said component narrowing generator 06, said component fan housing 08, said component cylinder fan 10, said component advance chamber 12, along with said component vortex cylinder 14. The said component 14 outer hot end by releasing its gas latent be used for the heating systems. The said component 14 inner cold end by releasing its cold gas stream be used for the cooling and refrigeration systems.

REFERENCE NUMBERS IN THE DRAWING AND WRITINGS embodiment apparatus 02 also known as; embodiment apparatus 02 embodiment apparatus 02 also known as; embodiment 02 component apparatus split-system "writings only"

component spiral tube 04 also known as; component 04 component narrowing generator 06 also known as; component 06 component fan housing 08 also known as; component 08 component cylinder fan 10 also known as; component 10 component advance chamber 12 also known as; component 12 component vortex cylinder 14 also known as; component 14 component heating chamber 16 also known as; component 16 component cooling chamber 18 also known as; component 18 component flash chamber 20 also known as; component 20 component condenser tube 22 also known as; component 22 component steam turbine 24 also known as; component 24 24: steam turbine-(M) 24: also known as; (M) 24 component drive shaft 26 also known as; component 26 component cooling tube 28 also known as; component 28 component water pump 30 also known as; component 30 component flash thermostatic valve 32 also known as; component 32 component flash tube 34 also known as; component 34 component flash pump 36 also known as; component 36

BRIEF DESCRIPTION OF THE DRAWING

The embodiments will now be described with reference to the accompanying drawing, wherein like reference numbers designate corresponding or identical elements throughout the various drawing. The drawings described herein are for illustration possible only and are not intended to limit the scope of the present disclosure in any way.

EMBODIMENT: COLD GAS AND GAS LATENT

Figure 1:
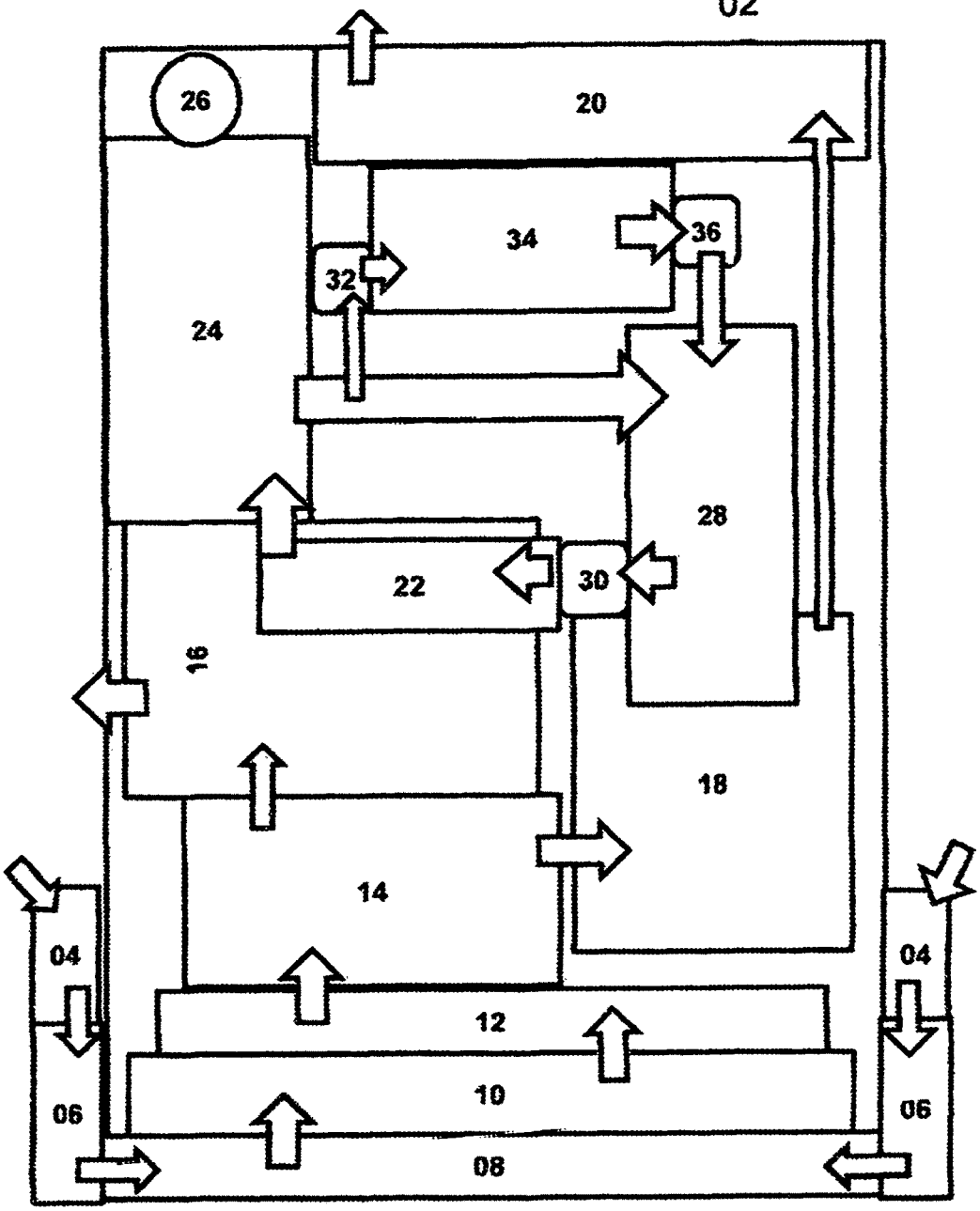
FIG. 1 is a perspective view of a cross-sectional of an embodiment apparatus 02.
Figure 2:
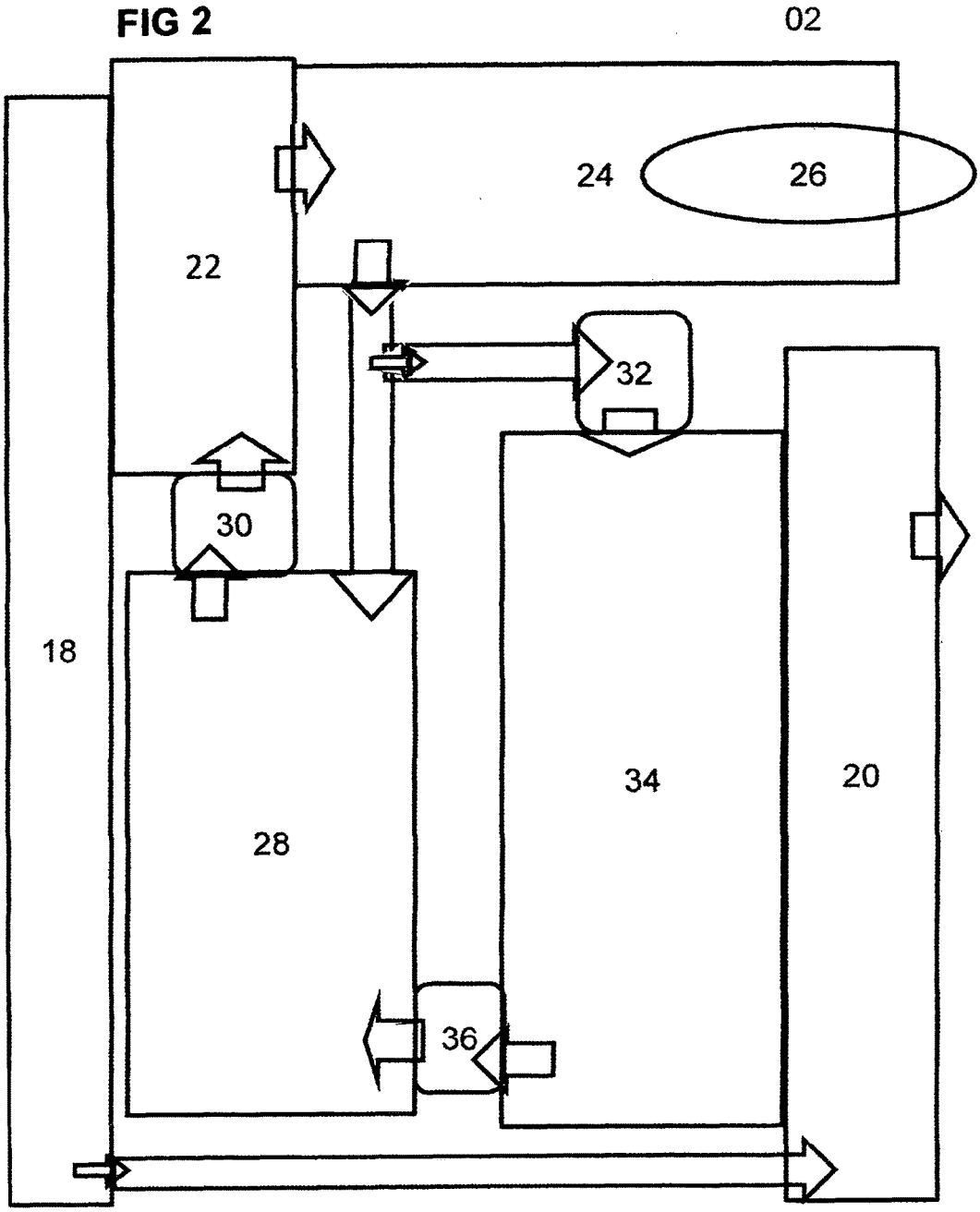
FIG. 2 is a perspective view of a cross-sectional of releasing gas latent heat energy, the condensate water to pressurized steam conversion cycle thereat within of said embodiment 02. The system constructed according to the principled of said embodiment 02.

The embodiments will now be described with reference to the accompanying drawing, wherein like reference numbers designate corresponding or identical elements throughout the drawing. The Vortex Turbine Engine also be known as a embodiment apparatus 02. The said embodiment 02 uses a component apparatus split-system for its split-system with its temperatures separation effect system.

The said component apparatus split-system comprises of: A component spiral tube 04, a component narrowing generator 06, a component fan housing 08, component cylinder fan 10, a component advance chamber 12, and a component vortex cylinder 14.

The ambient gas medium being drawn into each one of the said component spiral tube 04 ambient gas intake, the gas stream is being drawn in by said component cylinder fan 10. The said component 04 ambient gas intake with its ambient gas stream, the forward circumventing gas stream via the said component 04. The said component 04 with its gas stream, the gas stream via its vortex nozzle.

The said component spiral tube 04 vortex nozzle with its gas stream, the circumventing gas stream via its one of said component narrowing generator 06. The said component 06 with its forward circumventing gas stream, the gas stream via its vortex nozzle. The said component 06 vortex nozzle with its moving gas stream, the gas stream via said component fan housing 08.

The said component cylinder fan 10 joined to and lay in-between said component fan housing 08 within its inner wall. The said component 08 bottom converging portion being round has a greater diameter than the top portion being round, to enhance its gas stream intensity. The said component 10 spin on its horizontal-axis between the diameter interior side walls of said component 08. The said component 08 with its gas stream, the gas stream via said component 10. The said component spiral tube 04 ambient gas intake, said gas stream is being drawn in by said component 10 that being powered by its cylinder motor.

The gas stream after being drawn in by said component cylinder fan 10, the gas stream is then driven by said component 10. The said component 10 with its driven gas stream, the gas stream via the said component advance chamber 12. The said component 12 with its gas stream, the gas stream via its said tube outlets.

Each one of the said component advance chamber 12 tube outlets with its gas stream, the gas stream via said component vortex cylinder 14. The said component 14 having its temperatures, its temperatures have a separation effect within its vortex. The said component 14, its vortex outer gas latent temperature separate from its inner cold gas.

The said component vortex cylinder 14 with its temperatures separation effect have said vortex with an outer hot end releasing its gas latent. The said component 14 with an outer hot end releasing its gas latent to via the gas latent via its narrowing outer hot end outlet then via its adjustable hot outlet valve. The said component 14 having its adjustable hot outlet valve with its gas latent, the gas latent via a component heating chamber 16.

The said component vortex cylinder 14 with its temperatures separation effect have said vortex with an inner cold end releasing its cold gas. The said component 14 with an inner cold end releasing its cold to via said component 14 with its inner cold end outlet with its cold gas, the cold gas via a component cooling chamber 18.

A component condenser tube 22 with its condensate water to pressurized steam conversion, the condensate water absorb the gas latent lying within said component heating chamber 16. The said gas latent be lying within said component 16. The said condensate water to pressurized steam conversion be lying within said component 22. The said component 22 have a condensate water to pressurized steam conversion. The said component 16 with its gas latent, the gas latent via it's said component 16 gas vent.

The said component heating chamber 16 with its gas vent with its gas latent, the gas latent exit said embodiment apparatus 02. The component cooling tube 28 be lying within said component cooling chamber 18. The said component 18 with its cold gas, the cold gas stream absorb exhaust steam to warm water conversion lying within said component 28.

The said cold gas be lying within said component cooling chamber 18. The said exhaust steam to warm water conversion be lying within said component cooling tube 28. The said component 28 have a exhaust steam to warm water conversion. The said component 18 with its cold gas stream, the cold gas stream via a component flash chamber 20. A component flash tube 34 be lying within said component 20.

The said component flash chamber 20 with its cold gas, the cold gas stream absorbs the exhaust steam to hot water conversion lying within said component flash tube 34. The said cold gas be lying within said component 20. The said exhaust steam to hot water be lying within said component 34. The said component 34 have a exhaust steam to hot water conversion. The said component 20 with its cold gas, the cold gas via its cooling vent, and then the cold gas stream exit said embodiment apparatus 02.

Embodiment

The embodiments will now be described with reference to the accompanying drawing, wherein like reference numbers designate corresponding or identical elements throughout the drawing. Vortex Turbine Engine also be known as an embodiment apparatus 02.

A embodiment apparatus 02 comprises of: a component apparatus split-system, a component spiral tube 04, a component narrowing generator 06, a component fan housing 08, a component cylinder fan 10, a component advance chamber 12, a component vortex cylinder 14, also comprises of: a component heating chamber 16, a component cooling chamber 18, a component flash chamber 20, a component condenser tube 22, a component steam turbine 24, a component drive shaft 26, a component cooling tube 28, a component water pump 30, a component flash thermostatic valve 32, a component flash tube 34, a component flash pump 36.

A component apparatus split-system comprises of: A component spiral tube 04, a component narrowing generator 06, a component fan housing 08, a component cylinder fan 10, a component advance chamber 12, and a component vortex cylinder 14. The said component apparatus split-system embodiment portion be a closed area that have an opening at each one of the said component spiral tube 04 at each one of its ambient gas intake, the said component vortex cylinder 14 narrowing outer hot end outlet at its adjustable hot outlet valve.

A embodiment apparatus 02: The said embodiment 02 is suitable as a one, two, or a plurality of units. The said embodiment 02 is a closed area that have an opening at each one of a component spiral tube 04 at its ambient gas intake, a component heating chamber 16 at its gas vent, and a component flash chamber 20 at its cooling vent.

A component spiral tube 04: A embodiment apparatus 02 02 contain two or a plurality of said a component 04 with each one with an ambient gas intake and an ingrained vortex nozzle. There be the same amount of numbers of said component 04 with its vortex nozzle as there are in numbers of a component narrowing generator 06 with its vortex nozzle.

A component spiral tube 04: The ambient gas (mixture mainly of oxygen and nitrogen) gas medium being drawn into each one of said component 04 ambient gas intake, the gas stream is being drawn in by a component cylinder fan 10. Each one of said component 04 ambient gas intake is set at an angle to advance, generate, forming a vortex within each one of its one of said component 04. Each one of said component 04 contains a vortex.

A component spiral tube 04: The gas stream gains velocity while circumventing into said component 04 through its ambient gas intake and is drawn circumventing through said component 04 and through its vortex nozzle. Each one of said component 04 vortex nozzle is set at an angle to advance, generate, forming a vortex within each one of it's one of a component narrowing generator 06.

A component spiral tube 04: Each one of said component 04 converging portion has a greater diameter than the diverging portion, to enhance the vortices intensity. Each one of said component 04 converging portion has a greater diameter than the diverging portion, to enhance the vortices intensity within each one of it's one of a component narrowing generator 06. The said component 04 with its gas stream, the gas stream via its said vortex nozzle. Each one of said component 04 vortex nozzle with its gas stream, the gas stream via it's one of said component 06.

A component narrowing generator 06: Each one of a component spiral tube 04 vortex nozzle with its gas stream, the gas stream via it's one of said component 06. A embodiment apparatus 02 contain two or a plurality of said component 06 with each one with an ingrained vortex nozzle. There be the same amount of numbers of said component 06 with its vortex nozzle as there are in numbers of said component 04 with its vortex nozzle. Each one of said component 06 converging portion has a greater diameter than the diverging portion, to enhance its vortices intensity. Each one of said component 06 contains a vortex.

A component narrowing generator 06: The gas stream is drawn circumventing into said component 06 and through its vortex nozzle. The said component 06 gas stream gains velocity while circumventing, being drawn through said component 06 and through its vortex nozzle. Each one of said component 06 vortex nozzle with its gas stream, the gas stream via a component fan housing 08.

A component fan housing 08: Each one of a component narrowing generator 06 vortex nozzle with its gas stream, the gas stream via said component 08. The said component 08 is connected to a component advance chamber 12. A component cylinder fan 10 joined to and lay in-between said component 08 within its inner wall. The said component 10 spin on its horizontal-axis between the diameter interior side walls of said component 08. The said component 08 bottom converging portion being round has a greater diameter than the top portion being round, to enhance its gas stream intensity. The said (component 08 with its gas stream, the gas stream via said component 10.

A component cylinder fan 10: The said component 10 converts the mechanical energy from its a component cylinder fan 10 cylinder motor, to energize the moving gas stream. The energy of said cylinder motor energize said component 10 through its rotating movement. The said component 10 gas holes energize its rotating movement with an angle to capture the kinetic energy. The said component 10 joined to and lay in-between a component fan housing 08 within its inner wall. The said component 10 spin on its horizontal-axis between the diameter interior side walls of said component 08. The said component 10 be joined to at the bottom of said component 08.

A component cylinder fan 10: A component fan housing 08 with its gas stream, the gas stream via said component 10. The ambient air medium being drawn into each one of a component spiral tube 04 ambient gas intake, the gas stream is being drawn in by said component 10. The gas stream is then driven by said component 10. The said component 10 converging portion has a greater diameter than the diverging portion, to enhance the gas flow intensity within a component advance chamber 12. The said component 10 with its forward driven gas stream, the gas stream via said component 12.

A component advance chamber 12: A component cylinder fan 10 with its forward driven gas stream, the gas stream via said component 12. The said component 12 converging portion has a greater diameter than the diverging portion, to enhance the gas flow intensity within each one of its tube outlets. The said component 12 contain two or a plurality of its said tube outlets.

A component advance chamber 12: Each one of the said component 12 tube outlets converging portion have a greater diameter than the diverging portion, to enhance the vortices intensity within a component vortex cylinder 14. Each one of said component 12 tube outlets be connected to said component 14. Each one of said component 12 tube outlets contains a vortex. The A component fan housing 08 is connected to said component 12.

A component advance chamber 12: The said component 12 with its gas stream be driven by a component cylinder fan 10. The said component 12 with its gas stream, the gas stream via it's said component 12 tube outlets. Each one of said component 12 tube outlets is set at an angle to advance, generate, and helps to form a vortex within a component vortex cylinder 14. Each one of said component 12 tube outlets with its gas stream, the gas stream via said component 14.

A component vortex cylinder 14: Each one of a component advance chamber 12 tube outlets with its gas stream, the gas stream via said component 14. The said component 14 separate its compressed vortex gas stream into an gas latent heat stream and a cold stream. The said component 14 converging portion have a greater diameter than the diverging portion, to enhance the vortices intensity, along with its gas latent heat intensity of the vortex. The said component 14 contains a vortex.

A component vortex cylinder 14: Said component 14 is a split-system, splitting its gas latent heat from its gases. The said component 14 having its temperatures, its temperatures have a separation effect within its vortex. The said component 14, its vortex outer gas latent heat temperature separate from its inner gases. The said component 14 with its temperatures separation effect have the said vortex with an outer hot end releasing its gas latent heat. The said component 14 with its temperatures separation effect, this have its vortex with an inner cold end releasing its gases.

A component vortex cylinder 14: The said component 14 have narrowing outer hot end outlet at the outer top end of said component 14. The said component 14 narrowing outer hot end outlet converging portion have a greater diameter than the diverging portion, to enhance the gas latent heat intensity. The said component 14 narrowing outer hot end outlet have an adjustable hot outlet valve at the outer top end of said component 14 to adjust its gas latent heat outward flow.

A component vortex cylinder 14: The said component 14 with an outer hot end releasing its gas latent heat, the gas latent heat via its narrowing outer hot end outlet and then via its adjustable hot outlet valve. The said component 14 having its adjustable hot outlet valve with its gas latent heat, the gas latent heat via a component heating chamber 16.

A component vortex cylinder 14: The said component 14 have inner cold end outlet near the inner top end of said component 14. The said component 14 have inner cold end outlet. The said component 14 with an inner cold end releasing its cold gas, the cold gas air via it's said component 14 inner cold end outlet. The said component 14 with its inner cold end outlet with its cold gas, the cold gas via a component cooling chamber 18.

A component heating chamber 16: A component vortex cylinder 14 having its adjustable hot outlet valve with its gas latent heat, the gas latent heat via said component 16. A component condenser tube 22 be lying within said component 16. The said component 22 with its condensate water, the condensate water absorb the latent heat lying within said component 16. The said gas latent heat be lying within said component 16. Said component 16 with its gas latent heat, said component 22 absorbs said latent heat for a condensate water to pressurized steam conversion. The said condensate water absorbs latent heat to pressurized steam conversion be lying within said component 22. The said component 22 have a condensate water absorbs latent heat to pressurized steam conversion.

A component heating chamber 16: The said component 16 with its gas latent heat within, the gas latent heat via its gas vent. The said component 16 with its gas vent with its gas latent heat, the now cooler gas latent heat exit the embodiment apparatus 02.

A component cooling chamber 18: A component vortex cylinder 14 with its inner cold end outlet with its cold gases, the cold gases via said component 18. A component cooling tube 28 be lying within said component 18. The said component 18 with its cold gas stream, the cold gas stream absorb the latent heat from the exhaust water to hot water lying within said component 28. The said cold gases be lying within said component 18. The said exhaust water to warm water conversion be lying within said component 28. The said component 28 have an exhaust water to warm water conversion. The said component 18 with its cold gas, the cold gases via a component flash chamber 20.

A component flash chamber 20: A component cooling chamber 18 with its cold gases, the cold gases via said component 20. A component flash tube 34 be lying within said component 20. The said component 20 with its cold gases, the cold gas stream absorb the exhaust flash steam latent heat lying within said component 34. The said cold gas be lying within said component 20. The said exhaust flash steam heat be lying within said component 34. The said component 34 have a exhaust steam to hot water conversion. The said component 20 with its gases, the gases via its cooling vent. The said component 20 with its cooling vent with its gases, the gases exit the embodiment apparatus 02.

A component condenser tube 22: component water pump 30 with its warm condensate water, pumps the warm condensate water via said component 22. The said component 22 be lying within a component heating chamber 16. The said component 22 with its condensate water, the condensate water absorb the latent heat lying within said component 16. The the gas latent heat be lying within said component 16. The condensate water absorbs latent heat to pressurized steam conversion be lying within said component 22. The said component 22 have said condensate water absorbs latent heat to pressurized steam conversion. The said component 22 with its condensate water absorbs latent heat to pressurized steam conversion the pressurized steam via a component steam turbine 24.

A component steam turbine 24: A component condenser tube 22 with its condensate water absorbs latent heat to pressurized steam conversion, the pressurized steam via said component 24. The said component 24 with its pressurized steam flow generate a rotating motion force, forcing a component drive shaft 26 to rotate on its horizontal-axis producing torque. The said component 26 be joined to, being part of the said component 24. The said component 24 with its exhaust steam, the exhaust steam to exhaust water conversion via a component cooling tube 28.

A component drive shaft 26: A component steam turbine 24 with its pressurized steam flow generate a rotating motion force, forcing said component 26 to rotate on its horizontal-axis producing torque. The said component 26 be joined to, being part of said component 24.

A component cooling tube 28: A component steam turbine 24 with its exhaust steam, the exhaust steam to exhaust water conversion via said component 28. The exhaust steam coming from said component 24, this exhaust steam to exhaust water sometimes flash evaporation (also known as flash steam). The said component 28 with its flash steam, said flash steam diverted to a component flash thermostatic valve 32 with its diverter valve. The said component 28 with its exhaust water, the exhaust water to warm water conversion that did not flash evaporate to flash steam via toward a component water pump 30.

A component flash thermostatic valve 32: A component cooling tube 28 with its flash steam, the flash steam via the said component 32 with its diverter valve. The said component 32 with its diverter valve, the diverter valve divert the flash steam diverted to a component flash tube 34. The flash steam (also known as steam evaporation) that flash evaporation is released by said component 32 with its diverter valve.

A component flash tube 34: A component flash thermostatic valve 32 diverter valve with its flash steam, the flash steam diverter to said component 34. A component flash chamber 20 be lying within said component 34. The said component 20 with its cold gases, the cold gas stream absorb the flash steam latent heat lying within said component 34.

A component flash tube 34: The cold gases be lying within a component flash chamber 20. The exhaust steam to hot water conversion be lying within said component 34. The said component 34 have a exhaust steam to hot water conversion. The said component 34 with its exhaust steam to hot water conversion, the hot water via a component flash pump 36.

A component flash pump 36: A component flash tube 34 with its exhaust water to hot water conversion, the hot water via said component 36. The said component 36 with hot water, pumps the hot water to via a component cooling tube 28. The said component 36 pump this hot water to via said component 28 toward a component water pump 30.

A component cooling tube 28: A component flash pump 36 with its hot water, pumps the hot water to via said component 28. The said (component 28 with its exhaust water to hot water, the exhaust water that did not flash to flash steam lying within said component 28 via toward a component water pump 30. The said component 28 be lying within a component cooling chamber 18.

A component cooling tube 28: A component cooling chamber 18 with its cold gas stream, the cold gases absorb the latent heat from the exhaust water to warm water lying within said component 28. The said cold gases be lying within said component 18. The said exhaust water to warm water hot water be lying within said component 28. The said component 28 have a exhaust steam to warm water conversion. The said component 28 with its exhaust steam to warm water conversion, the warm water via a component water pump 30.

A component water pump 30: A component cooling tube 28 with its exhaust steam to warm water conversion, the exhaust steam to warm water conversion via toward said component 30. The said component 30 with its warm water, pumps the warm water to via a component condenser tube 22. The pumping causes a vacuum within said component 28, drawing said exhaust steam to warm water conversion toward said component 30. The said component 22 with its condensate water absorbs latent heat to pressurized steam conversion therefore commence a condensate water absorbs latent heat to pressurized steam conversion cycle thereat.

Embodiment: Non-Vapor Compression A Component Apparatus Split-system

A component apparatus split-system: A portion of a embodiment apparatus 02 is a non-vapor compression. This portion of said embodiment 02 be known as; said component apparatus split-system (non-vapor compression, heating, cooling and refrigeration). The said component apparatus split-system with its temperatures separation effect, separating its cold gas from its latent heat is an embodiment portion of said embodiment 02. The said component apparatus split-system systems, is systems being used in said embodiment 02 to heat and cool its gas stream. The said component apparatus split-system is a non-vapor compression that uses no refrigerant.

A component apparatus split-system: The said component apparatus split-system systems embodiment portion be a closed area that have an opening at each one of a component spiral tube 04 at its ambient gas intake, a component vortex cylinder 14 at its inner cold end outlet, and a opening at its adjustable hot outlet valve. The said component apparatus split-system contain two or a plurality of said component 04 with each one with an ambient gas intake and an ingrained vortex nozzle. The ambient gas medium being drawn into each one of said component 04 ambient gas intake, the gas stream is being drawn in by a component cylinder fan 10.

A component spiral tube 04: Each one of said component 04 ambient gas intake is set at an angle to advance, generate, forming a vortex within each one of its one of said component 04. Each one of said component 04 contains a vortex. The gas stream gains velocity while circumventing into said component 04 through its ambient gas intake and is drawn circumventing through said component 04 with its vortex nozzle. Each one of said component 04 vortex nozzle is set at an angle to advance, generate, forming a vortex within each one of it's one of a component narrowing generator 06.

A component spiral tube 04: Each one of said component 04 converging portion has a greater diameter than diverging portion, to enhance vortices intensity. Each one of said component 04 converging portion has a greater diameter than diverging portion, to enhance the vortices intensity within each one of it's one of a component narrowing generator 06. The said component 04 with its gas stream, the gas stream via its said vortex nozzle. Each one of said component 04 vortex nozzle with its gas stream, the gas stream via within each of its own one of said component 06. There be the same amount of numbers of said component 04 with its vortex nozzle as there are in numbers of said component 06 with its vortex nozzle.

A component narrowing generator 06: Each one of a component spiral tube 04 vortex nozzle with its gas stream, the gas stream via it's one of said component 06. A component apparatus split-system contain two or a plurality of said component 06 with each one with an ingrained vortex nozzle. There be the same amount of numbers of said component 06 with its vortex nozzle as there are in numbers of said component 04 with its vortex nozzle. Each one of said component 06 converging portion has a greater diameter than the diverging portion, to enhance its vortices intensity.

A component narrowing generator 06: Each one of said component 06 contains a vortex. The gas stream is drawn circumventing into said component 06 and through its vortex nozzle. The said component 06 gas stream gains velocity while circumventing, being drawn through said component 06 and through its vortex nozzle. Each one of said component 06 vortex nozzle with its gas stream, the gas stream via a component fan housing 08.

A component fan housing 08: Each one of a component narrowing generator 06 vortex nozzle with its gas stream, the gas stream via said component 08. The said component 08 is connected to a component advance chamber 12.

A component cylinder fan 10 joined to and lay in-between the said component 08 within its inner wall. The said component 10 spin on its horizontal-axis between the diameter interior side walls of said component 08. The said component 08 bottom converging portion being round has a greater diameter than the top portion being round, to enhance its gas stream intensity.

A component cylinder fan 10: The said component 10 converts the mechanical energy from its cylinder motor, to energize the moving gas stream. The energy of said cylinder motor energize said component 10 through its rotating movement. The said component 10 gas holes energize its rotating movement with an angle to capture the kinetic energy. The said component 10 joined to and lay in-between a component fan housing 08 within its inner wall. The said component 10 spin on its horizontal-axis between the diameter interior side walls of said component 08. The said component 10 be joined to at the bottom of said component 08.

A component cylinder fan 10: A component fan housing 08 with its gas stream, the gas stream via said component 10. The ambient gas medium being drawn into each one of a component spiral tube 04 ambient gas intake, the gas stream is being drawn in by said component 10. The gas stream is then driven by said component 10. The said component 10 converging portion have a greater diameter than the diverging portion, to enhance the gas flow intensity within a component advance chamber 12. The said component 10 with its forward driven gas stream, the gas stream via said component 12.

A component advance chamber 12: A component cylinder fan 10 with its forward driven gas stream, the gas stream via said component 12. The said component 12 converging portion has a greater diameter than the diverging portion, to enhance the gas flow intensity within each one of its tube outlets. The said component 12 contain two or a plurality of its tube outlets.

The a component advance chamber 12: Each one of the said component 12 tube outlets converging portion have a greater diameter than the diverging portion, to enhance the vortices intensity within a component vortex cylinder 14. Each one of said component 12 tube outlets be connected to said component 14. Each one of said component 12 tube outlets contains a vortex. A component fan housing 08 is connected to said component 12.

A component advance chamber 12: The said component 12 with its gas stream be driven by a component cylinder fan 10. The said component 12 with its gas stream, the gas stream via it's said component 12 tube outlets. Each one of said component 12 tube outlets is set at an angle to advance, generate, and helps to form a vortex within a component vortex cylinder 14. Each one of said component 12 tube outlets with its gas stream, the gas stream via said component 14.

A component vortex cylinder 14: Each one of component advance chamber 12 tube outlets with its gas stream, the gas stream via said component 14. said component 14 separate its compressed vortex gas stream into an gas latent stream and a cold stream. The said component 14 converging portion have a greater diameter than the diverging portion, to enhance the vortices intensity, along with its gas latent intensity of the vortex. The said component 14 contains a vortex.

A component vortex cylinder 14: The said component 14 having its temperatures, its temperatures have a separation effect within its vortex. The said component 14, its vortex outer gas latent temperature separate from its inner cold gas. The said component 14 with its temperatures separation effect have said vortex with an outer hot end releasing its gas latent. The said component 14 with its temperatures separation effect, this have its vortex with an inner cold end releasing its cold gas.

A component vortex cylinder 14: The said component 14 have an narrowing outer hot end outlet at the outer top end of said component 14. The said component 14 narrowing outer hot end outlet converging portion have a greater diameter than the diverging portion, to enhance the gas latent intensity. The said component 14 narrowing outer hot end outlet with an adjustable hot outlet valve at the outer top end of said component 14 to adjust its gas latent outward flow.

A component vortex cylinder 14: The said component 14 with an outer hot end releasing its gas latent, the gas latent via its narrowing outer hot end outlet and then via its adjustable hot outlet valve. The said component 14 narrowing outer hot end outlet with its adjustable hot outlet valve with its gas latent, the gas latent exit A component apparatus split-system.

A component vortex cylinder 14: The said component 14 have an inner cold end outlet near the outer top end of said component 14. The said component 14 with an inner cold end releasing its cold gas, the cold gas via it's said component 14 inner cold end outlet. The said component 14 with its inner cold end outlet with its cold gas, the cold gas exit a component apparatus split-system.

Embodiment: Information

Air induction: The gas (mixture mainly of oxygen and nitrogen) being drawn into a component spiral tube 04, causing an gas pressure buildup on the atmospheric high pressure regions. The vacuum in the front of the molecules, in this high pressure region causes the molecules (matter) to accelerate toward the low pressure regions. Gas induction is used within said component 04 and then the gas flow via its one of a component narrowing generator 06.

Atmospheric gases: The common name given to the atmospheric gases used in breathing and photosynthesis is air. In a gas, the molecules have enough energetic so that the effect of intermolecular forces is small, and the typical distance between neighboring molecules is much greater than the molecular size.

Atmospheric pressure: Is the force per unit area exerted on a surface by the weight of gas above that surface, the higher the atmospheric pressure, the higher the ambient air pressure buildup. The drawing of the ambient gas pressure causes a vacuum in the high pressure regions. The vacuum in the front of the molecules causes the molecules to accelerate toward the low pressure regions.

Atmospheric pressure: A embodiment apparatus 02 uses the atmospheric pressure high and low pressure regions. A component cylinder fan 10 draws the ambient gas medium into said embodiment 02, through a component spiral tube 04 ambient gas intake, then through its ingrained vortex nozzle, a component narrowing generator 06 with its ingrained vortex nozzle, then driven through a component advance chamber 12, said component 12 tube outlets and a component vortex cylinder 14. The drawing of its gases from the high pressured regions causes a vacuum in front of the high pressured regions. This cause a vacuum (low pressure) in the atmospheric high pressure regions, this vacuum in front of the high pressure causes the molecules to accelerate toward the low pressure regions.

Bernoulli principle: The correlation between gas speed and pressure, as speed increases pressure decreases, as the gas is curving. The continuous change of position of a body of gas stream curving within a embodiment apparatus 02, so that every partied of the body follows a straight-line path. The Bernoulli principle is used in a component spiral tube 04 with its ingrained vortex nozzle, a component narrowing generator 06, with its ingrained vortex nozzle, a component advance chamber 12, said (component 12 tube outlets and a component vortex cylinder 14 narrowing outer hot end outlet and inner cold end outlet.

Conservation laws, in physics: As gas is drawn circumventing into a component spiral tube 04, a component narrowing generator 06, then driven through a component advance chamber 12 with its tube outlets and a component vortex cylinder 14 and said component 14 narrowing outer hot end outlet, a corresponding volume must move a greater distance in their narrowing of the passageways and thus have a greater speed. At the same time, the work done by corresponding volumes in the narrowing of the passageways will be expressed by the product of the pressure and the volume. Since the speed is greater in the narrowing of the passageways, the energetic of that volume is greater. Then, by the law of conservation of energy, this increase in kinetic energy must be balanced by a decrease in the pressure-volume product, or, since the volumes are equal, by a decrease in pressure.

Converging and diverging portions: Each one of these: A component spiral tube 04 with its ingrained vortex nozzle, a component narrowing generator 06 with its ingrained vortex nozzle, a component advance chamber 12, said component 12 tube outlets and a component vortex cylinder 14, all of these has a converging and diverging portion, to enhance the vortices intensity. The said component 14 narrowing outer hot end outlet has a converging and diverging portion, to enhance the gas latent heat temperature intensity. The converging portion has a greater diameter than the diverging portion. The converging portion has a high capacity and a low velocity. The diverging portion will have a low capacity and a high velocity with a back pressure. The ambient pressure, referred to as lower atmospheric pressure, (back pressure) causes the gas stream to accelerate. By reducing the pressure of the gases at the exit of the expansion portion, in effect, the molecules leave the outlets at their thermal speed without colliding with other molecules. This is because the molecules are all moving in the same relative direction and at the same speed.

Diverter valve: The pressure is relieved by allowing the pressurized steam (flash evaporation) to flow from a component cooling tube 28, the pressurized flash steam via the diverter valve of a component flash thermostatic valve 32. The diverter valve is designed or set to open at a predetermined set pressure to protect said component 28 and the other equipment from being subjected to pressures that exceed their design limits. The said component 32 control the volume and temperature, and by using a diverter valve this divert the steam be released by the said component 32, this flash steam diverted to a component flash tube 34.

Flash steam: Is a name given to the steam formed from hot condensate when the pressure is reduced. Flash steam is no different from normal steam. The exhaust steam to exhaust water that is produced from a component steam turbine 24, this exhaust steam to exhaust water via a component cooling tube 28. Whereas flash steam occurs when high pressure and high temperature condensate is exposed to a large pressure drop such as when being released by said component 24 and via said component 28. High temperature condensate contains high energy that cannot remain in liquid form at a lower pressure because there is more energy than that required to achieve saturated water at the lower pressure. The result is that some of the excess energy causes a % of the condensate to flash within said component 28.

Heat transfer: Describes the exchange of thermal energy, between physical systems depending on the temperature and pressure, by dissipating heat. The fundamental modes of heat transfer are conduction or diffusion, convection and radiation. The exchange of kinetic energy of particles: Through the boundary between two systems at different temperatures, from each other from their surroundings. Heat transfer always occurs from a region of high temperature to another region of lower temperature. Heat transfer changes the internal energy of both systems involved according to the First Law of Thermodynamics. The Second Law of Thermodynamics defines the concept of thermodynamic entropy, by measurable heat transfer. A embodiment apparatus 02 uses its two systems with the different temperatures. A component vortex cylinder 14 have a inner cold end outlet, releasing its cold gases. The said component 14 have an narrowing outer hot end outlet with its adjustable hot outlet valve, releasing its gas latent heat. A component condenser tube 22 uses said component 14 narrowing outer hot end outlet with its adjustable hot outlet valve, releasing its gas latent. A component flash tube 34 and component cooling tube 28 uses said component 14, inner cold end outlet releasing its releasing its cold gases.

Kinetic Molecular Theory of Matter: Is a concept that basically states that atoms and molecules possess energy of motion (kinetic energy) that we perceive as temperature. In other words, atoms and molecules are constantly in motion, and we measure the energy of these movements as the temperature of that substance. This means if there is an increase in temperature, the atoms and molecules will gain more energy (kinetic energy) and move even faster. A component spiral tube 04, a component narrowing generator 06, a component advance chamber 12, said component 12 tube outlets, a component vortex cylinder 14; possesses energy of motion.

Kinetic momentum: The momentum which a particle possesses because of its motion, equal to the particle's mass times it velocity. A component spiral tube 04, a component narrowing generator 06, a component advance chamber 12, said component 12 tube outlets, a component vortex cylinder 14 gas outward motion mass, equal times it velocity. The rotational energetic depends on rotation about an axis, and for a body of constant moment of inertia is equal to the product of half the moment of inertia times the square of the angular velocity. In relativistic physics kinetic energy is equal to the product of the increase of mass caused by motion times the square of the speed of light.

component vortex cylinder 14: The said component 14 with a converging portion that has a greater diameter than the diverging portion. The said component 14 consists of a high pressure circumventing gas stream that enters said component 14 and the gas latent heat gasses through its said narrowing outer hot end outlet and then through it's said adjustable hot outlet valve. The gas expands through its said adjustable hot outlet valve and achieves a high angular velocity, causing a vortex-type flow. There are two exits to said component 14: said narrowing outer hot end outlet that the gas latent heat passing through and then through said adjustable hot outlet valve, that exit is placed near the outer radius of said component 14 at the end away from its said inner cold end outlet exit that is placed at the center of said component 14 at the same end as said adjustable hot outlet valve. By adjusting its said narrowing outer hot end outlet with said adjustable hot outlet valve downstream of the said exit, it is possible to vary the fraction of the incoming air flow that leaves through it's said inner cold end outlet, referred as cold fraction. This adjustment affects the amount of cold and hot energy that leaves said component 14 through its exits. Results in an increase of the twice maximized cooling heat transfer rate of nearly 330% from 300 kPa to 700 kPa. (700 kPa =101.52642 Psi)

Pressure: Is a defined as the force per unit area exerted against a surface by the weight of the gas above that surface. In terms of molecules, if the number of molecules above a surface increases, there are more molecules to exert a force on that surface and consequently, the pressure increases.

Ranque-Hilsch vortex tube: The vortex tube has been used for many decades in various engineering applications. Because of its compact design and little maintenance requirements, it is very popular in heating and cooling processes. There is no unifying theory that explains the temperature separation phenomenon inside the vortex tube. The vortex tube is a mechanical device that separates compressed gas into an outward radial high temperature region and an inner lower one. There are two classifications of the vortex tube. Both of these are currently in use in the industry. The more popular is the counter-row vortex tube and the Uni-flow vortex tube. A component vortex cylinder 14 is similar to with many characterize of the Uni-flow vortex tube.

Steam: Is a term for the gaseous phase of water, which is formed when water boils. Technically speaking, in terms of the chemistry and physics, steam is invisible and cannot be seen, however in common language it is often used to refer to the visible mist or aerosol of water droplets formed as this water vapor condenses in the presence of (cooler) gas. At lower pressures, such as in the upper atmosphere or at the top of high mountains water boils at a lower temperature than the nominal 100° C. (212° F.) at standard temperature and pressure. Today's vortex tube with its adjustable valve can reach temperatures as high as +200° C. and the gas emerging from its inner cold end can reach −50° C. are possible. A component vortex cylinder 14 separate its gas stream into an gas latent heat stream and a cold stream. The said component 14, the converging portion has a greater diameter than the diverging portion, to enhance the vortices intensity giving this an added higher temperatures along with its narrowing outer hot end outlet with its adjustable hot outlet valve. A component steam turbine 24 needs 500° C. (932° F.) (500 kPa=72.5188 Psi) to produce its needed steam pressure. The said component 14 with its narrowing outer hot end outlet and along with its adjustable hot outlet valve giving the needed 500° C. (932° F.) (500 kPa=72.5188 Psi) to produce its needed steam pressure. To increase of the twice maximized cooling heat transfer rate of nearly 330% from 300 kPa to 700 kPa. (700 kPa=101.52642 Psi).

Steam turbine: There are two basic types of the steam turbines; blades or the nozzles. Blades move entirely due to the impact of steam on them and their profiles do not converge. This results in a steam velocity drop and essentially no pressure drop as steam moves through the blades. A turbine composed of blades alternating with fixed nozzles is called an impulse turbine, Curtis turbine, Rateau turbine, or Brown-Curtis turbine. Nozzles appear similar to blades, but their profiles converge near the exit. This results in a steam pressure drop and velocity increase as steam moves through the nozzles. Nozzles move due to both the impact of steam on them and the reaction due to the high-velocity steam at the exit. A turbine composed of moving nozzle alternating with fixed nozzles is called a reaction turbine or Parsons Turbine. The steam turbines are well known, as these has many characterize of a component steam turbine 24.

Vacuum: An approximation to such vacuum is a region with a gaseous pressure much less than atmospheric. This causes the circumventing gas stream (molecule) to accelerate toward the low pressure regions. A embodiment apparatus 02 uses these vacuums to move the gas stream from high pressure regions to low pressure regions. The drawing of the gases from the high pressured regions causes a vacuum in front of the high pressured regions. This causes a vacuum (low pressure) in the atmospheric high pressure region, with this vacuum in front of the high pressure causes the molecules accelerate toward the low pressure regions. A component spiral tube 04 along with a component narrowing generator 06, use this drawing of the ambient gas medium, causing a vacuum (low pressure). A component cooling tube 28 uses the (vacuum) low pressure regions to draw the flowing exhaust water to warm water toward a component water pump 30.

Vortex: The vortices are a measure of the intensity of a vortex. An important mechanism that enhances the vortices is the stretching of the vortex—stretching along the axis of the vortex, makes it rotate faster and decreases its diameter in order to constantly maintain its kinetic momentum. A component spiral tube 04, a component narrowing generator 06, a component advance chamber 12, a said (component 12 tube outlets and a component vortex cylinder 14 uses this stretching to enhance the vortices intensity.

Vortex nozzle: The vortex nozzle is also call a CD-nozzle or a convergent-divergent nozzle. The air enters the converging section, its velocity increases, considering the mass flow rate to be constant. The gas passes through the throat, it attains sonic velocity (Mach number=1). As the gas passes through the divergent section, the gas velocity to be supersonic (also Mach 1). The air speed be keep subsonic. A component spiral tube 04 with its vortex nozzle, along with a component narrowing generator 06 with its vortex nozzle, all of these use its converging and divergent to increase velocity.

Vortex tube: The water boils at 100° C. at the standard temperature and pressure. Today's vortex tube outer hot end can reach temperatures as high as +200° C. and the gas emerging from its inner cold end can reach −50° C. are possible. A component vortex cylinder 14 separate its compressed gas into an gas latent heat stream and a cold stream. Each one of a component spiral tube 04 narrowing passageway, along with each one of a component narrowing generator 06 narrowing passageway, a component advance chamber 12 and said component 12 tube outlets, and along with said component 14, all of these have their converging portion have a greater diameter than the diverging portion, to enhance the vortices intensity giving an added higher temperatures and pressure. The said component 14 with its narrowing outer hot end outlet and along with its adjustable hot outlet valve giving the needed 500° C. (932° F.) (500 kPa =72.5188 Psi) to produce its needed steam pressure. The adjustable hot outlet valve increase of the twice maximized cooling heat transfer rate of nearly 330% from 300 kPa to 700 kPa. (700 kPa =101.52642 Psi).

Embodiment Communication, Connected, Joined, Means, Supports

Embodiment has the means to be attached, connected, continuous, joined to or in transmission of something from one point to another point. A embodiment apparatus 02 has the means to attach to and supports each one of the structures of its embodiments. The said embodiment 02 in communication with one, two, or with a plurality of units or an assembly of units. The said embodiment 02 has the means to and be in communication with each embodiment. Each embodiment be in communication with said embodiment 02.

Each one of a component spiral tube 04 have an ambient gas intake. Each one of said component 04 with its ingrained vortex nozzle is connected to it's one of a component narrowing generator 06. Each one of said component 06 with its ingrained vortex nozzle is connected to a component fan housing 08.

Embodiment: Transfer to, Means to

Transfer to: A component spiral tube 04, a component narrowing generator 06, a component fan housing 08, a component cylinder fan 10, a component advance chamber 12, said component 12 tube outlets, a component vortex cylinder 14 said component 14 inner cold end outlet, said component 14 narrowing outer hot end outlet or adjustable hot outlet valve, a component heating chamber 16, a component cooling chamber 18, and a component flash chamber 20, are compartment, tube or pipe with the means to transfer the gas stream and or the gas latent heat from one point to the next point.

Transfer to: A component condenser tube 22, a component cooling tube 28, a component flash tube 34 are compartment, tube or pipe with the means to transfer the steam and or the water from one point to the next point. A component water pump 30 and along with a component flash pump 36 with the means to transfer the water from one point to the next point.

Means to: A embodiment apparatus 02 to have means to start, stop, and control or adjust the cylinder motor to rotate or to spin a component cylinder fan 10 on its horizontal-axis shaft. The said component 10 be joined within and at the bottom end of a component fan housing 08, with the means to rotate on its horizontal-axis. The said component 10 utilizes its said cylinder motor with the means to start, stop, and control or adjust its rotating or spinning within said component 08. The said cylinder motor has the means to force said component 10 on its horizontal-axis shaft to rotate or to spin.

Means to: A embodiment apparatus 02 to have means to start, stop, and control, adjust a component water pump 30, a component flash pump 36 and a component flash thermostatic valve 32 with its diverter valve. A sensor with the means to adjust and control the water level that being release by said component 30. A component condenser tube 22, a component cooling tube 28, and a component flash tube 34 have the means, to adjust and/or control the water level or its water temperature.

Means to: The component vortex cylinder 14 inner cold end outlet has the means to adjust, this adjustment to have the effects of the amount of cold and hot energy that leaves said component 14 through its exit. The said component 14 narrowing outer hot end outlet with an adjustable hot outlet valve built into the outer hot end releasing its gas latent heat.

Embodiment: Hydrophilic Polymers Grafting Treatment

The hydrophilic polymers: The hydrophilic polymers grafting treatment along walls that are exposed to water as needed: A component condenser tube 22, a component steam turbine 24, a component cooling tube 28, a component water pump 30, the diverter valve of a component flash thermostatic valve 32, a component flash tube 34, and a component flash pump 36 with the option to use, have, or be grafted along any or any other areas, where treatment is needed.

HydroLAST™: HydroLAST™ is a process by which hydrophilic polymers are grafted permanently to the surface of a hydrophobic substrate. The hydrophilic polymer has carboxyl, hydroxil, or amine functionalities that serve to loosely bind water. Once treated, the substrate "wets out" and allows water and reagents to flow easily over or through it (in the case of porous substrates). Unlike conventional hydrophilic treatments such as straight plasma, corona, or ozone processing, the surface is permanently rather than transiently hydrophilic.

Embodiment: Alternative Embodiment

DETAILED DESCRIPTION

Vortex Turbine Engine

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The present description provides for Vortex Turbine Engine also be known as a embodiment apparatus 02: The said embodiment 02 is a closed area that have an opening at each one of a component spiral tube 04 narrowing passageway at its ambient gas intake, a component heating chamber 16 at its gas vent, and a component flash chamber 20 at its cooling vent.

The said embodiment apparatus 02 comprises of a component apparatus split-system, a component spiral tube 04, a component narrowing generator 06, a component fan housing 08, a component cylinder fan 10, a component advance chamber 12, a component vortex cylinder 14, said embodiment apparatus 02 also comprises of a component heating chamber 16, a component cooling chamber 18, a component flash chamber 20, a component condenser tube 22, a component steam turbine 24, a component drive shaft 26, a component cooling tube 28, a component water pump 30, a component flash thermostatic valve 32, a component flash tube 34, a component flash pump 36.

The said embodiment apparatus 02 contain two or a plurality of said component spiral tube 04 with each one with an ambient gas intake and an ingrained vortex nozzle. Each one of said component 04 ambient gas intake is set at an angle to advance, generate, forming a vortex within each one of its one of said component 04. The ambient gas medium being drawn into each one of said component 04 ambient gas intake, the gas stream is being drawn in by said component cylinder fan 10.

Each one of said component spiral tube 04 converging portion has a greater diameter than the diverging portion, to enhance the vortices intensity. Each one of said component 04 narrowing passageway converging portion has a greater diameter than the diverging portion, to enhance the vortices intensity within each one of it's one of said component narrowing generator 06.

Each one of said component spiral tube 04 contains a vortex. Each one of said component 04 vortex nozzle is set at an angle to advance, generate, forming a vortex within each one of its one of said component narrowing generator 06. The said component 04 with its gas stream, the air stream via its said vortex nozzle. Each one of said component 04 vortex nozzle with its gas stream, the gas stream via it's one of said component 06.

The said embodiment apparatus 02 contain two or a plurality of said component narrowing generator 06 with each one with an ingrained vortex nozzle. There be the same amount of numbers of said component spiral tube 04 with its vortex nozzle as there are in numbers of said component 06 with its vortex nozzle. Each one of said component 06 converging portion has a greater diameter than the diverging portion, to enhance its vortices intensity. Each one of said component 06 contains a vortex.

The gas stream is drawn circumventing into said component narrowing generator 06 and through its vortex nozzle. The said component 06 gas stream gains velocity while circumventing, being drawn through said component 06 and through its vortex nozzle. Each one of said component 06 vortex nozzle with its gas stream, the gas stream via said component fan housing 08.

The said component fan housing 08 is connected to said component advance chamber 12. The said component cylinder fan 10 joined to and lay in-between said component 08 within its inner wall. The said component 10 spin on its horizontal-axis between the diameter interior side walls of said component 08. The said component 08 bottom converging portion being round has a greater diameter than the top portion being round, to enhance its gas stream intensity. The said component 08 with its gas stream, the gas stream via said component 10.

The said component cylinder fan 10 converts the mechanical energy from cylinder motor, to energize the moving gas stream. The energy of said cylinder motor energize said component 10 through its rotating movement. The said component 10 gas holes energize its rotating movement with an angle to capture the kinetic energy. The said component 10 be joined to and lay in-between said component fan housing 08 within its inner wall. The said component 10 be joined to at the bottom of said component 08.

The ambient gas medium being drawn into each one of said component spiral tube 04 ambient gas intake, the gas stream is being drawn in by said component cylinder fan 10. The gas stream is then driven by said component 10. The said component 10 converging portion have a greater diameter than diverging portion, to enhance the gas flow intensity within the said component advance chamber 12. The said component 10 with its forward driven gas stream, the gas stream via said component advance chamber 12.

The said component advance chamber 12 converging portion has a greater diameter than the diverging portion, to enhance the gas flow intensity within each one of its tube outlets. The said component 12 contain two or a plurality of its tube outlets. Each one of said component 12 tube outlets converging portion have a greater diameter than the diverging portion, to enhance the vortices intensity within the said component vortex cylinder 14.

Each one of said component advance chamber 12 tube outlets be connected to said component vortex cylinder 14. Each one of said component 12 tube outlets contains a vortex. The said component fan housing 08 is connected to said component 12. The said component 12 with its gas stream driven by said component cylinder fan 10.

The said component advance chamber 12 with its gas stream, the gas stream via its said tube outlets. Each one of the said component 12 tube outlets is set at an angle to advance, generate, and helps to form a vortex within said component vortex cylinder 14. Each one of said component 12 tube outlets with its gas stream, the gas stream via said component 14.

The said component vortex cylinder 14 separate its compressed gas into an gas latent heat stream and a cold stream. The said component 14 converging portion have a greater diameter than the diverging portion, to enhance the vortices intensity, along with its gas latent heat intensity of the vortex. The said component 14 contains a vortex.

The said component vortex cylinder 14 having its temperatures, its temperatures have a separation effect within its vortex. The said component 14, its vortex outer gas latent heat temperature separate from its inner cold gas. The said component 14 with its temperatures separation effect have said vortex with an outer hot end releasing its gas latent heat. The said component 14 with its temperatures separation effect have its vortex with an inner cold end releasing its cold gas.

The said component vortex cylinder 14 have an narrowing outer hot end outlet at the outer top end of said component 14. The said component 14 narrowing outer hot end outlet converging portion have a greater diameter than the diverging portion, to enhance the gas latent heat intensity. The said component 14 narrowing outer hot end outlet have an adjustable hot outlet valve at the outer top end of said component 14 to adjust its gas latent heat outward flow.

The said component vortex cylinder 14 with an outer hot end releasing its gas latent heat, the gas latent heat via its narrowing outer hot end outlet and then via its adjustable hot outlet valve. The said component 14 having its adjustable hot outlet valve with its gas latent heat, the gas latent heat via said component heating chamber 16.

The said component vortex cylinder 14 have an inner cold end outlet near the inner top end of said component 14. The said component 14 with an inner cold end outlet releasing its cold gas, the cold gas via it's said component 14 inner cold end outlet. The said component 14 with its inner cold end outlet, with its cold gas, the cold gas via said component cooling chamber 18.

The said gas latent heat be lying within said component heating chamber 16. The said component condenser tube 22 be lying within said component 16. The said component 22 with its warm water, the warm water absorb the latent heat lying within said component 16. The said condensate water absorbs latent heat to pressurized steam conversion be lying within said component 22. The said component 22 have condensate water to pressurized steam conversion. The said component 16 with its gas latent heat within, the gas latent heat via its gas gas vent exiting said embodiment apparatus 02. The said component heating chamber 16 with its gas gas vent with its gas latent heat, the now cooler gas latent heat exit said embodiment apparatus 02.

The said component cooling chamber 18 with its cold gas stream, the cold gas stream absorb the latent heat from the exhaust water to hot water lying within said component cooling tube 28. The said component 28 be lying within said component 18. The said cold gas be lying within said component 18. The said exhaust water to hot water be lying within said component 28. The said component 28 have a exhaust water to warm water conversion. The said component 18 with its cold gas, the cold gas via said component flash chamber 20.

The said component flash chamber 20 with its cold gas, the cold gas stream absorb the exhaust water to hot water latent heat lying within said component flash tube 34. The said component 34 be lying within said component 20. The said cold gas be lying within said component 20. Said exhaust water to hot water be lying within said component 34. The said component 34 have a exhaust steam to hot water conversion. The said component 20 with its cold gas, the cold gas via its cooling vent. The said component 20 with its cooling vent with its cold gas, the cold gas exit said embodiment apparatus 02.

The said component water pump 30 with its warm condensate water, pumps the warm condensate water to via said component condenser tube 22. The said component 22 with its condensate water absorbs latent heat to pressurized steam conversion, the pressurized steam via said component steam turbine 24. The said component 24 with its pressurized steam flow generate a rotating motion force, forcing said component drive shaft 26 to rotate on its horizontal-axis producing torque.

The said component drive shaft 26 be joined to, being part of said component steam turbine 24. The said component 24 with its exhaust steam to exhaust water, the exhaust water via said component cooling tube 28. The exhaust steam coming from said component 24, this exhaust steam to exhaust water sometimes flash evaporation (also known as flash steam).

The said component cooling tube 28 with its flash steam, the flash steam via said component flash thermostatic valve 32 with its diverter valve. The said component 28 with its exhaust water, the exhaust steam to warm water conversion that did not flash evaporate to flash steam via toward said component water pump 30.

The said component flash thermostatic valve 32 with its diverter valve, the diverter valve divert the flash steam diverted to via said component flash tube 34. The said flash steam that flash evaporation is released by the said component 32 with its diverter valve.

The said component flash tube 34 with its exhaust steam to hot water conversion, the hot water via said component flash pump 36. The said component 34 with its exhaust steam to hot water conversion, the hot water via said component 36. The said component 36 with its hot water hot-warm water, pumps the hot water to via said component cooling tube 28. The said component 36 pump this hot water to via said component 28 toward said component water pump 30.

The said component cooling tube 28 with its exhaust steam to warm water conversion, the exhaust water that did not flash to flash steam lying within said component 28 via toward said component water pump 30. The said component 28 with its exhaust steam to warm water conversion, the warm water via said component 30.

The said component water pump 30 with its warm condensate water, pumps the warm condensate water to via said component condenser tube 22. The pumping causes a vacuum within said component cooling tube 28, drawing said condensate water to pressurized steam conversion toward the said component 30. The said component 22 with its condensate water absorbs latent heat to pressurized steam conversion therefore commence the condensate water absorbs latent heat to pressurized steam conversion warm cycle thereat.

Embodiment:In Many Different Forms

While the invention is susceptible to embodiment in many different forms, as shown in the drawings and will be described to herein in detail, specific embodiments thereof with the understanding that the present disclosure is to be considered as an exemplification of the principles of the invention and is not to be limited to the specific embodiments described.

Each example is provided by way of explanation of the invention, not limitation of the invention. In fact, it will be apparent to those skilled in the art that various modifications and variations can be made in the present invention without departing from the scope or spirit of the invention.

For instance, features illustrated or described as component of one embodiment can be used with another embodiment to yield a still further embodiment.

Thus, it is intended that the present invention covers such modification and variations as come within the scope of the appended claims and their equivalents. It should be appreciated that the present invention is not limited to any particular type or style depicted in Figure's and is for illustrative purposes only.

Ramifications Of Detailed Description

Although preferred embodiments have been depicted and described in detail therein, it will be apparent to those skilled in the relevant art that various modifications, additions, substitutions and the like can be made without departing from the spirit of the invention and these are therefore considered to be within the scope of the invention as defined in the following claims. All water temperatures, pressurized steam, gas temperatures, gases velocity or gas pressures used are an estimate, based on information attained.

One of these changes could be without departing from essence present invention, by having other kinds of gases moving devices, such as using other kinds of engines, motors or multi-speed turbo fan motors to pull and drive the gas stream into and through the apparatus. Having the motor placed in other locations, on, within or outside of the apparatus. Having the apparatus to use other kinds of, gases blower holes or blades. There being other kinds of means to drive the apparatus other than electrically. Other kinds of power sources, like using solar energy. Use isolation material and formulation to reduce vibrations and dissipate shock energy for the motor and gas mover.

Other change could be having the gases intakes or gases outlets, placed higher or lower, smaller or larger, more or less of them on the apparatus. There being other kinds of tubes or piping, or more vortexes or other kinds of on-off switches, nozzles, controllers, rate adjusters or other kinds of adjuster.

It is not practical to describe in claims all possible embodiments, Embodiments may be accomplished generally in keeping with present invention. Disclosure may include, separately or collectively, aspects described found throughout description of patent. While these may be added to explicitly include such details. Existing claims should construe to encompass such aspects.

To the extent methods claimed in present invention are not further discussed. Any such methods are natural outgrowths of the system or apparatus claims.

Therefore, separate and further discussions of the methods are deemed unnecessary. Otherwise claim steps implicit in use and manufacture or systems or apparatus claims.

Furthermore, steps organized in logical fashion and other sequences can and do occur. Therefore, method claims should not be construed to include only this order. Other order and sequence steps may be presented.

Notice: Subject to any disclaimer, the term of patent is extended or adjusted under 35 U.S.C. 154(b) by 501 days.

It is to be understood that the present invention is not limited to the embodiments described above, but encompasses any and all embodiments within the following scope of the following claims.

The invention claimed is:

1. A process for providing a vortex turbine engine embodiment apparatus that is a closed area having an opening at each one of a component spiral tube at an ambient gas intake and an opening at a component heating chamber at a gas vent and an opening at a component flash chamber at a cooling vent;

said embodiment apparatus draws in a medium low pressure gas by a component cylinder fan through two or a plurality of said component spiral tubes having an each one with the ambient gas intake set at an angle to induce its gases to spin tangentially within said component spiral tube with its converging intake portion has a greater diameter than the diverging outlet portion with an ingrained vortex nozzle set at an angle to induce its gases to spin tangentially having said gases flow through a component narrowing generator;

said component narrowing generator converging intake portion has a diameter greater than said diverging outlet portion with its ingrained vortex nozzle set at an angle to induce its gases to spin tangentially having said gases flow through a component fan housing, then said gases being drawn into said component cylinder fan;

said component cylinder fan with its converging intake portion has a diameter greater than diverging outlet portion and said component cylinder fan joined to and lying within said component fan housing, then said gases within are driven by said component cylinder fan having said gases flow through a component advance chamber;

said component advance chamber with its converging intake portion has a diameter greater than diverging outlet portion with its tube outlets set at an angle to induce its gases to spin tangentially having said gases flow through a component vortex cylinder;

said component vortex cylinder with an inner cold end outlet, with its cold gases flowing through a component cooling chamber with said gases then flowing through said component flash chamber with a cooling vent with said gases then exiting said embodiment apparatus;

said component vortex cylinder with its converging portion has a diameter greater than diverging portion to enhance the stretching vortices intensity along with its gas latent heat intensity of the vortex and said component vortex cylinder having an narrowing outer hot end outlet and its hot gases flowing through an attached adjustable hot outlet valve, then said hot gases flow through said component heating chamber with its gas vent with said gases exiting the embodiment apparatus;

a component condenser tube absorbs any latent heat from said component heating chamber to facilitate condensate water to pressurized steam conversion traverses a steam via a component steam turbine with its pressurized steam causing a component drive shaft to rotate on its horizontal-axis;

said component steam turbine with its exhaust steam flowing through a component cooling tube said exhaust steam hot water sometimes flash evaporates condensate hot water to pressurized steam conversion steam and said flash evaporation of said steam via a component flash thermostatic valve with its diverter valve diverting said steam then said steam via a component flash tube;

said component flash tube with its flash steam to exhaust water then having said exhaust water latent heat to be absorb by cold gases within said component flash chamber and said component flash tube with said exhaust steam to hot water conversion water then said water via a component flash pump pumps water to via said component cooling tube toward a component water pump;

said component steam turbine with its exhaust steam hot water flowing into said component cooling tube with said exhaust steam hot water to warm water conversion water that did not flash, evaporates to flash steam via said water flowing through said component cooling tube;

said component cooling tube with its hot water to warm water conversion water, said water flows into said component water pump, then said component water pump pumps said water to said component condenser tube there by commencing the conversion cycle of condensate water with its absorbed latent heat to pressurized steam.

2. A process of claim 1 comprising: an embodiment apparatus draws in a medium low pressure gas by a component cylinder fan through two or more of a component spiral tube having an each one with an ambient gas intake set at an set at an angle to induce its gases to spin tangentially within said component spiral tube with its converging intake portion having a greater diameter than the diverging outlet portion with its ingrained vortex nozzle set at an angle to induce its gases to spin tangentially.

3. A process of claim 1 comprising: the embodiment apparatus draws in a medium low pressure gas by a component cylinder fan through two or a plurality of a component spiral tube.

4. A process of claim 1 comprising: a component spiral tube with its converging intake portion having a greater diameter than the diverging outlet portion.

5. A process of claim 1 comprising: a component spiral tube with its ingrained vortex nozzle set at an angle to induce its gases to spin tangentially.

6. A process of claim 1 comprising: a component narrowing generator converging intake portion has a diameter greater than diverging outlet portion with its ingrained vortex nozzle set at an angle to induce its gases to spin tangentially having its gases flow into a component fan housing with said gases being drawn into by said component cylinder fan.

7. A process of claim 1 comprising: gases being drawn into a component cylinder fan that is joined to and lying within a component fan housing then its gases are driven by said component cylinder fan having said gases flow through a component advance chamber.

8. A process of claim 1 comprising: a component advance chamber with its converging intake portion having a diameter greater than diverging outlet portion with its tube outlets set at an angle to induce its gases to spin tangentially having said gases flow into a component vortex cylinder.

9. A process of claim 1 comprising: a component advance chamber with its converging intake portion has a diameter greater than diverging outlet portion.

10. A process of claim 1 comprising: a component advance chamber with its tube outlets set at an angle to induce its gases to spin tangentially having said gases flow into a component vortex cylinder.

11. A process of claim 1 comprising: a component vortex cylinder with its inner cold end outlet with its cold gases to flow into a component cooling chamber with said gases flow into a component flash chamber with its cooling vent with said gases then said gases exits the embodiment apparatus.

12. A process of claim 1 comprising: a component fan housing with its converging intake portion has a diameter greater than diverging outlet portion.

13. A process of claim 1 comprising: a component vortex cylinder having a narrowing outer hot end outlet and its hot gases flow to its attached adjustable hot outlet valve then said hot gases flow into a component heating chamber with a gas vent with its gases then exiting the embodiment apparatus.

14. A process of claim 1 comprising: a component vortex cylinder with its converging portion has a diameter greater than diverging portion to enhance the stretching vortices intensity along with its gas latent heat intensity of the vortex having an narrowing outer hot end outlet enhance the latent heat intensity and its hot gases flow to its attached adjustable hot outlet valve then said hot gases flow into a component heating chamber.

15. A process of claim 1 comprising: a component condenser tube that absorbs the latent heat from a component heating chamber for condensate water to pressurized steam conversion said steam flows into a component steam turbine with its pressurized steam causing a component drive shaft with its steam to rotate on its horizontal-axis.

16. A process of claim 1 comprising: a component condenser tube absorbs the latent heat from a component heating chamber for condensate water to pressurized steam conversion said steam flows into a component steam turbine.

17. A process of claim 1 comprising: a component steam turbine with its exhaust steam flowing via a component cooling tube, said hot water sometimes flash evaporation and its flash evaporation steam flowing via a component flash thermostatic valve with its diverter valve diverting said flash steam then said steam via a component flash tube.

18. A process of claim 1 comprising: a component flash tube with its flash steam to exhaust water then having said exhaust water latent heat to be absorbed by cold gases within a component flash chamber and said component flash tube with said exhaust steam to hot water conversion water then said water flows into a component flash pump, pumps said water to flows into a component cooling tube toward a component water pump.

19. A process of claim 1 comprising: a component steam turbine with its exhaust steam hot water, said hot water flowing via a component cooling tube with said exhaust water to warm water conversion water that did not flash evaporate to flash steam, said water flows toward a component water pump.

20. A process of claim 1 comprising: a component cooling tube with exhaust water to warm water conversion water, said water flows into a component water pump that pumps said water to a component condenser tube therefore commencing the condensate water absorbs latent heat to pressurized steam conversion cycle.

* * * * *